US006220038B1

(12) United States Patent
Marsh et al.

(10) Patent No.: US 6,220,038 B1
(45) Date of Patent: Apr. 24, 2001

(54) ICE MAKER

(75) Inventors: John K. Marsh, Wolcottville; Donald E. Dewitt, Syracuse; Andrei Tchougounov, Ligonier, all of IN (US)

(73) Assignee: Group Dekko Services, LLC, Kendallville, IN (US)

( * ) Notice: Subject to any disclaimer, the term of this patent is extended or adjusted under 35 U.S.C. 154(b) by 0 days.

(21) Appl. No.: 09/574,786

(22) Filed: May 19, 2000

Related U.S. Application Data

(60) Division of application No. 09/499,011, filed on Feb. 4, 2000, which is a continuation-in-part of application No. 09/285,283, filed on Apr. 2, 1999, now Pat. No. 6,082,121.

(51) Int. Cl.[7] ..... F25C 1/12
(52) U.S. Cl. ..... 62/71; 62/75; 62/353
(58) Field of Search ..... 62/71, 75, 353, 62/354, 356

(56) References Cited

U.S. PATENT DOCUMENTS

| | | | |
|---|---|---|---|
| 948,131 | 2/1910 | Bull | 62/356 |
| 1,963,842 | 6/1934 | Gay | 62/105 |
| 2,775,101 | 12/1956 | Hanson | 62/356 |
| 3,196,624 | 7/1965 | Reynolds | 62/71 |
| 3,274,792 | 9/1966 | Weil et al. | 62/354 |
| 3,654,772 | 4/1972 | Curry, III | 62/353 |
| 3,678,701 | 7/1972 | Powell et al. | 62/353 |
| 3,708,992 | 1/1973 | Clearman et al. | 62/71 |
| 3,896,631 | 7/1975 | Morrison | 62/71 |
| 3,984,996 | 10/1976 | Bright | 62/353 |
| 4,003,214 | 1/1977 | Schumacher | 62/340 |
| 4,183,222 | 1/1980 | Swanson | 62/71 |
| 4,355,522 | 10/1982 | Gorski et al. | 62/340 |
| 4,429,543 | 2/1984 | Fischer | 62/347 |
| 4,732,006 | 3/1988 | Fischer | 62/71 |
| 4,901,539 | 2/1990 | Garber et al. | 62/356 |
| 5,167,132 | 12/1992 | Meier | 62/356 |

FOREIGN PATENT DOCUMENTS

| | | | |
|---|---|---|---|
| 351706 | 3/1921 | (DE) | 62/356 |

*Primary Examiner*—William E. Tapolcai
(74) *Attorney, Agent, or Firm*—Taylor & Aust, P.C.

(57) ABSTRACT

An ice maker includes a mold and an auger. The mold has at least one cavity with a bottom surface, and is configured for containing water therein for freezing into ice. The auger has a shaft with at least one flight attached thereto, the shaft including a top end and a base end with the base end being rotatably mounted in the bottom surface of the at least one mold cavity. The shaft extends substantially vertically through the mold cavity and is configured to rotate and thereby push the ice out of the mold cavity. The shaft and/or at least one flight has an inward taper in a direction heading from the base end to the top end of the shaft.

22 Claims, 5 Drawing Sheets

ICE MAKER

This is a divisional of U.S. patent application Ser. No. 09/499,011, filed Feb. 4, 2000, which is a continuation-in-part of U.S. patent application Ser. No. 09/285,283 filed Apr. 2, 1999, now U.S. Pat. No. 6,082,121.

CROSS-REFERENCE TO RELATED APPLICATIONS

BACKGROUND OF THE INVENTION

1. Field of the Invention

The present invention relates to freezers, and, more particularly, ice-making devices.

2. Description of the Related Art

The freezer portion of a refrigeration/freezer appliance often includes an ice cube maker which dispenses the ice cubes into a dispenser tray. A mold has a series of cavities, each of which is filled with water. The air surrounding the mold is cooled to a temperature below freezing so that each cavity forms an individual ice cube. As the water freezes, the ice cubes become bonded to the inner surfaces of the mold cavities.

In order to remove an ice cube from its mold cavity, it is first necessary to break the bond that forms during the freezing process between the ice cube and the inner surface of the mold cavity. In order to break the bond, it is known to heat the mold cavity, thereby melting the ice contacting the mold cavity on the outermost portion of the cube. The ice cube can then be scooped out or otherwise mechanically removed from the mold cavity and placed in the dispenser tray. A problem is that, since the mold cavity is heated and must be cooled down again, the time required to freeze the water is lengthened.

Another problem is that the heating of the mold increases the operational costs of the ice maker by consuming electrical power. Further, this heating must be offset with additional refrigeration in order to maintain a freezing ambient temperature, thereby consuming additional power. This is especially troublesome in view of government mandates which require freezers to increase their efficiency.

Yet another problem is that, since the mold cavity is heated, the water at the top, middle of the mold cavity freezes first and the freezing continues in outward directions. In this freezing process, the boundary between the ice and the water tends to push impurities to the outside of the cube. Thus, the impurities become highly visible on the outside of the cube and cause the cube to have an unappealing appearance. Also, the impurities tend to plate out or build up on the mold wall, thereby making ice cube removal more difficult.

A further problem is that vaporization of the water in the mold cavities causes frost to form on the walls of the freezer. More particularly, in a phenomenon termed "vapor flashing", vaporization occurs during the melting of the bond between the ice and the mold cavity. Moreover, vaporization adds to the latent load or the water removal load of the refrigerator.

Yet another problem is that the ice cube must be substantially completely frozen before it is capable of withstanding the stresses imparted by the melting and removal processes. This limits the throughput capacity of the ice maker.

What is needed in the art is an ice maker which does not require heat in order to remove ice cubes from their cavities, has an increased throughput capacity, allows less evaporation of water within the freezer, eases the separation of the ice cubes from the auger and does not push impurities to the outer surfaces of the ice cubes.

SUMMARY OF THE INVENTION

The present invention provides an ice maker which, without heat, mechanically breaks the bond between the ice cubes and the mold cavities before the water is completely frozen. This method of breaking the bond increases throughput, conserves energy and allows the ice cubes to freeze on the outside first and continue freezing in an inward direction. By eliminating the melting procedure, the ice maker substantially reduces vaporization of water within the freezer, which is further reduced by sealing the water in the mold cavities from the ambient air.

The invention comprises, in one form thereof, an ice making apparatus including a mold having a cavity with a bottom surface. The mold cavity is configured for containing water therein for freezing into ice. An auger extends substantially vertically through the mold cavity. The auger is configured for rotating to thereby push the ice out of the mold cavity. The auger includes a rotatable surface at least partially defining the bottom surface of the mold cavity. The rotatable surface includes at least one ramp configured for lifting the ice off of the bottom surface of the mold cavity.

The invention comprises, in yet another embodiment thereof, an ice maker which includes a mold and an auger. The mold has at least one cavity with a bottom surface, and the at least one mold cavity is configured for containing water therein for freezing into ice. The auger includes a shaft having a longitudinal axis and having at least one flight attached thereto, the shaft including a top end and a base end with the base end being rotatably mounted in the bottom surface of the at least one mold cavity. The shaft extends substantially vertically through said at least one mold cavity and is configured to rotate and thereby push the ice out of said at least one mold cavity. The shaft and/or at least one flight has a radius that decreases relative to the longitudinal axis in a direction heading from the base end to the top end of the shaft and thereby has a radially inward taper in that direction.

An advantage of the present invention is that heat is not needed in order to break the bond between the ice cubes and their mold cavities, thereby conserving energy and reducing operational costs.

Another advantage is that, since the mold cavities are not heated, and since the ice cubes are not completely frozen before being removed from their cavities, the time spent freezing the water in the cavities is reduced, and the throughput rate is increased.

Yet another advantage is that, since the mold cavities are not heated, the water freezes from the outside in, thereby pushing impurities to the inside of the cube, where they are less conspicuous and do not plate out on the mold surface.

A further advantage is that, since the step of melting the outer surface of the ice is eliminated, and since the water is sealed from ambient air while freezing, vaporization of the water is greatly reduced, resulting in less frost on the wall of the freezer and less water that the refrigerator must remove.

A still further advantage is that the provision of at least one inward taper allows an ice cube to automatically become separated from at least a portion of the auger upon movement of the ice cube in an output direction. Even though the ice cube has an inward taper to match that of the auger, the inner diameter of the ice cube at a given location therein has its own specific value. Meanwhile, the diameter of at least a portion of the auger adjacent to that given location, the diameter of the shaft and/or the outer diameter of the at least one flight, continually decreases relative to the inner diameter of that given location as the ice cube is moved in the output direction. Consequently, since the contact area per unit length between the auger and an ice cube decreases as the ice cube moves along the auger, the friction per unit length therebetween also decreases.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 2:
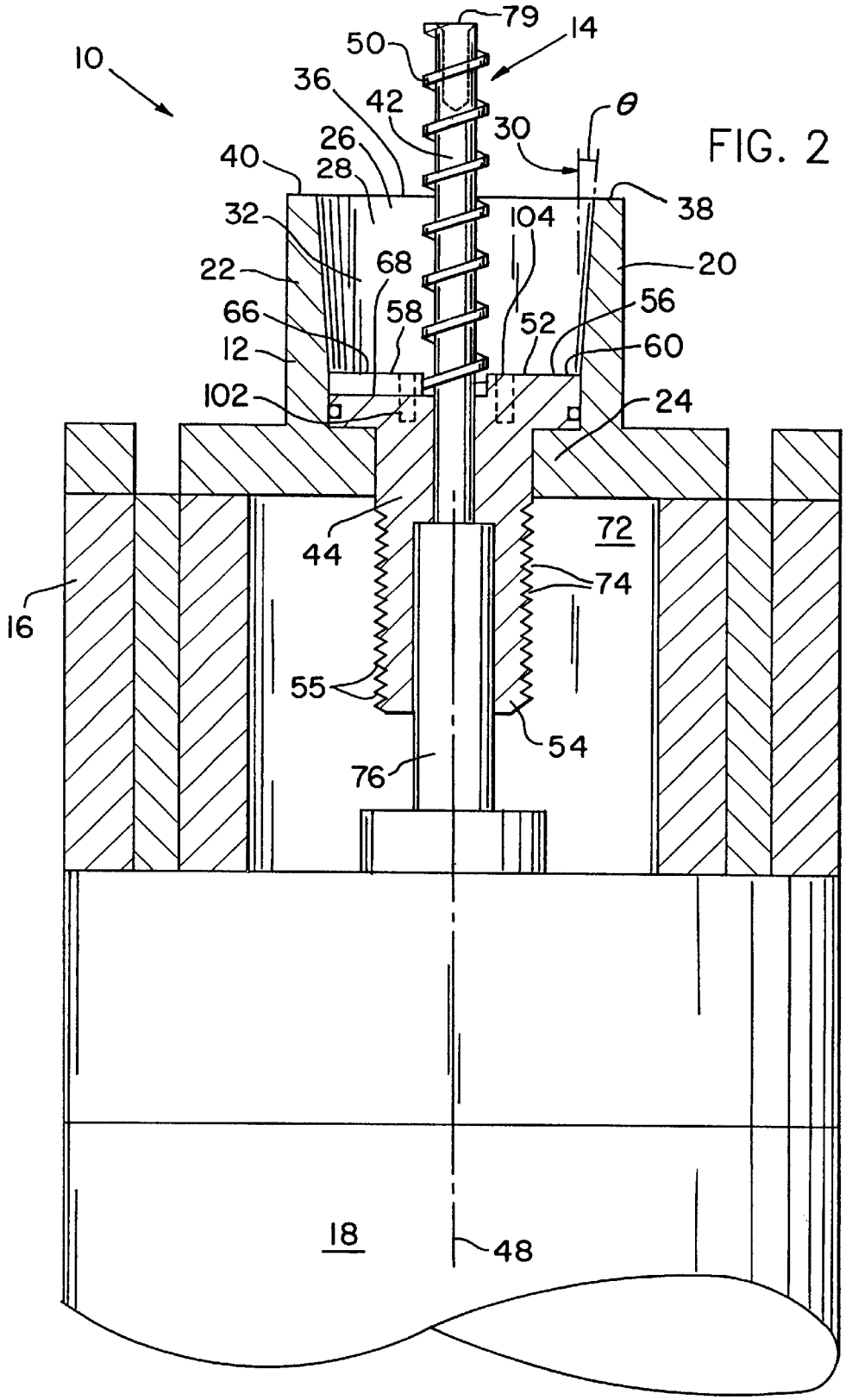
FIG. 2 is a front, partially sectional view of one embodiment of an ice making apparatus of the present invention.

Referring now to the drawings, and particularly to FIG. 2, there is shown an ice making apparatus 10including a mold 12, a rotatable auger 14, a housing 16 and a drive mechanism 18. For ease of illustration, ice making apparatus 10 is shown as including only a single mold 12. However, it is to be understood that ice making apparatus 10 may include multiple molds 12 for delivering multiple ice cubes.

Figure 3:
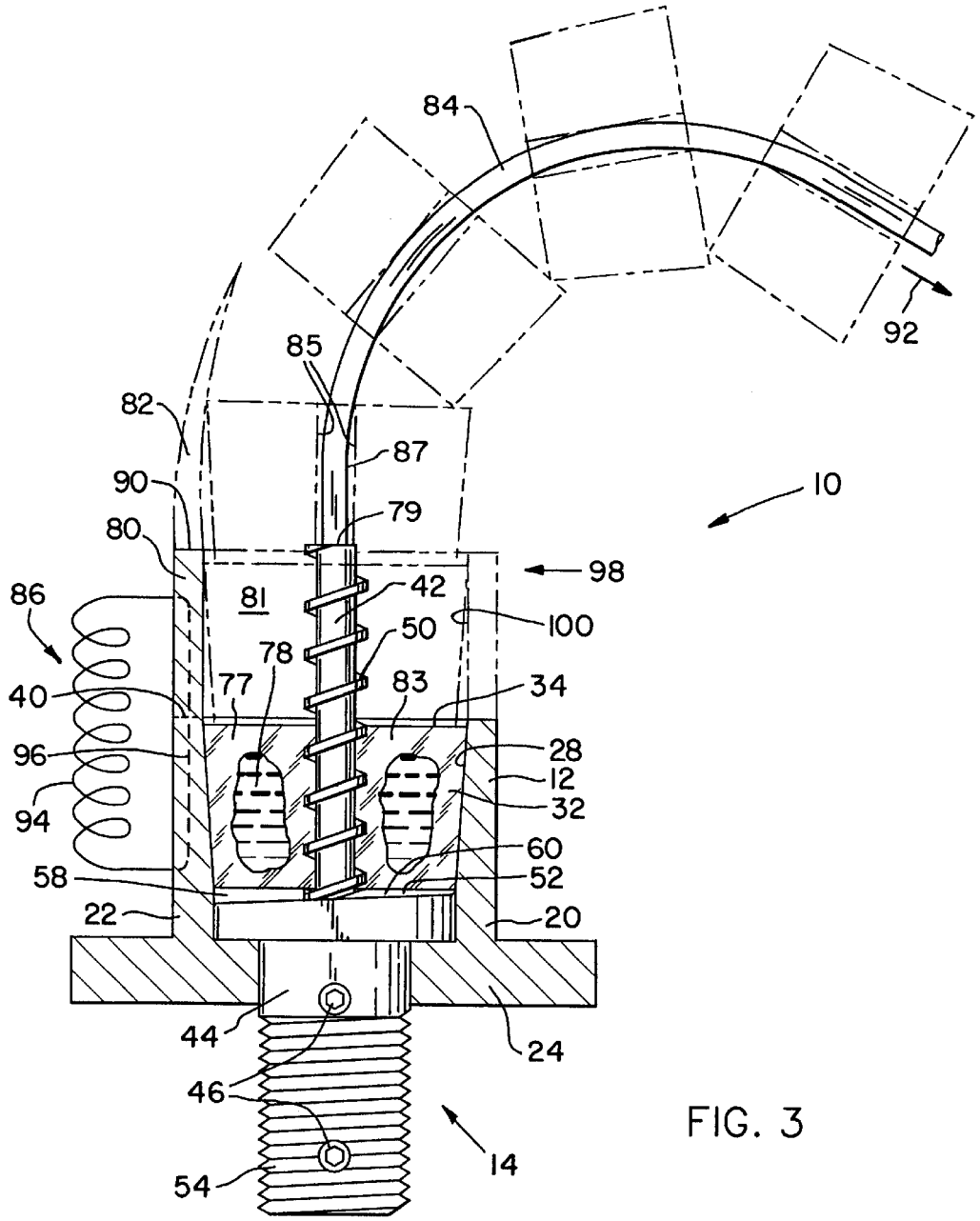
FIG. 3 is a front, enlarged, fragmentary, partially sectional view of another embodiment of an ice making apparatus of the present invention.

Mold 12 includes a front wall 20, a back wall 22, a base 24 and a side wall 26. Another side wall 27 (FIG. 1) is also included in mold 12, but is not shown in the partially sectional view of FIG. 2. An inner surface 28 of each of perimeter walls 20, 22, 26 and 27 is slanted outwardly at an angle Θ relative to a vertical direction indicated by dotted line 30. Angle Θ can be approximately between 1° and 5°, and is preferably approximately 3°. Walls 20, 22, 26 and 27 retain water within a cavity 32 of mold 12. A level of the water's surface is indicated with a horizontal line 34 shown in an alternative embodiment in FIG. 3. A top edge 36 of side wall 26 is visible in FIG. 2, and is at the same vertical level as a top edge of side wall 27 and the respective top edges 38 and 40 of front wall 20 and back wall 22. Auger 14 includes a shaft 42 and a lifter 44 which are fixedly joined together by set screws 46. It is also possible for shaft 42 and lifter 44 to be formed together as a one-piece, monolithic auger. Auger 14, including both shaft 42 and lifter 44, rotates about a longitudinal axis 48 which extends vertically through the center of cavity 32. Shaft 42 includes a continuous series of spiraling flights 50, each of which is spaced approximately 0.2 inch from each vertically adjacent flight 50. That is, there are five flights 50 per vertical inch.

Figure 1:
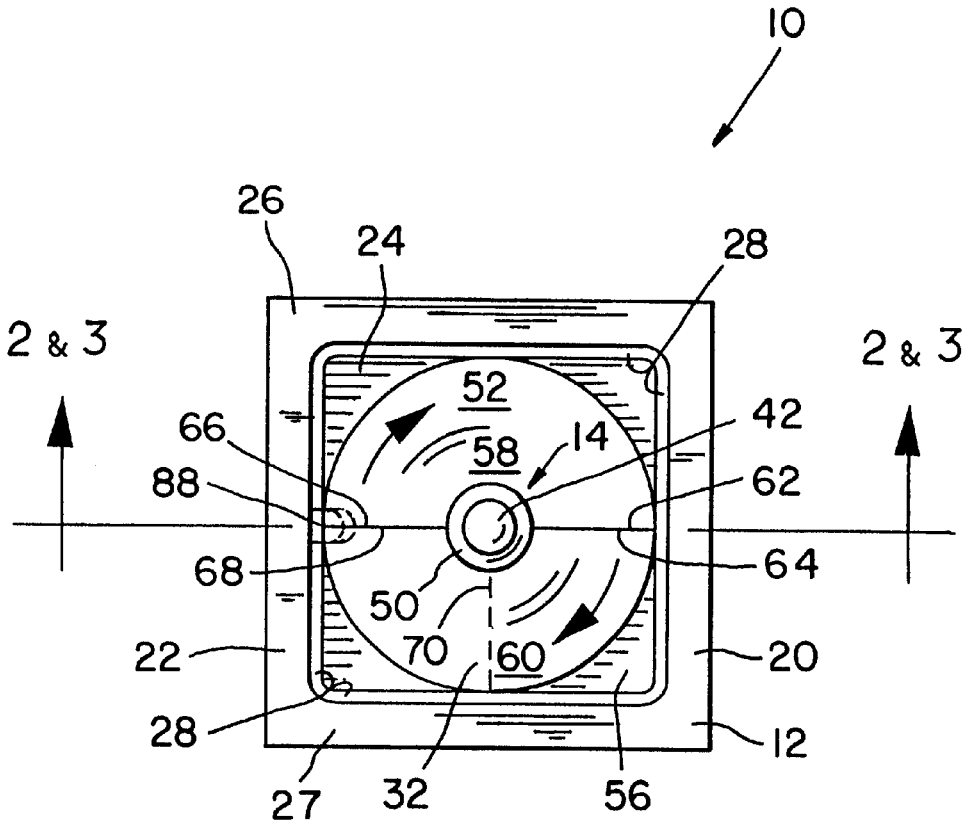
FIG. 1 is a top view of the mold and auger of the ice making apparatus of FIG. 1.

Lifter 44 includes a rotatable surface 52 and a shank 54 having threads 55. As best seen in FIG. 1, surface 52 is substantially circular with a diameter of approximately 1.0 inch. Surface 52 partially defines a bottom surface 56 of cavity 32, with base 24 of mold 12 defining the remainder of bottom surface 56. Rotatable surface 52 includes two ramps 58 and 60, each of which forms one half of surface 52. A bottom 62 of ramp 58 is adjacent to a top 64 of ramp 60. Conversely, 180° away, a top 66 of ramp 58 is adjacent to a bottom 68 of ramp 60. Each of ramps 58 and 60 has a drop of 0.1 inch in a clockwise direction as viewed in FIG. 1. Thus, each of ramps 58 and 60 has a slope of 0.1 inch per half rotation, or 0.2 inch/rotation, matching the slope of flights 50. Further, the vertical level of surface 52 along any radius is constant. For example, the vertical level of surface 52 along radius 70, half way down ramp 60, is 0.05 inch above bottom 68 of ramp 60 and 0.05 inch below top 64 of ramp 60. Housing 16 supports mold 12 and contains drive mechanism 18. Housing 16 includes an internally threaded cup 72 having threads 74 which interface with threads 55 of shank 54.

Drive mechanism 18 functions to rotate auger 14 through an output shaft 76 which is coupled with shank 54. Drive mechanism 18 may be in the form of an electrical motor, for example.

In operation, cavity 32 is filled with water to an appropriate level, such as that of the illustrated water surface 34, by any suitable method. The air surrounding both ice making apparatus 10 and the water is cooled below 32° F. by refrigeration such that the water at least partially freezes. Mold 12 and auger 14 are maintained below freezing and thus absorb heat from the water that is adjacent to these parts in cavity 32. Ice first forms in the areas of cavity 32 that are adjacent mold 12 and auger 14 to thereby form a shell 77 surrounding the remaining water 78 in cavity 32.

Once an outer shell 77 of ice has formed in cavity 32, drive mechanism 18 can be used to lift the ice out by rotating auger 14 in a clockwise direction, as viewed in FIG. 1. Threaded cup 72 of housing 16 functions to allow auger 14 to rotate, while at the same time holding down auger 14.

During the freezing process, a bond forms between the ice and mold cavity 32. More particularly, a bond forms between the ice and each of bottom surface 56 and walls 20, 22, 26 and 27. Before the ice cube can be lifted out of cavity 32, these bonds must be broken while, at the same time, not breaking the relatively fragile outer shell 77 of the ice cube.

As auger 14 rotates, ramps 58 and 60 function as shearing devices which break the bond between the ice and bottom surface 56 of cavity 32. Since the ice cube is approximately square-shaped, it cannot rotate within cavity 32. Ramps 58, 60 and flights 50 work together to lift the ice upward at a same rate. By ramps 58, 60 and flights 50 operating conjunctively, the total upward force exerted on the ice cube is spread out over a greater surface area of the cube, thereby minimizing the chances of breaking the ice cube. The shearing and upward forces exerted on the ice cube by ramps 58 and 60 as they rotate, as well as the additional upward force exerted by flights 50, is enough to break the bonds between the ice and mold 12. The surface finish on inner surface 28 and rotatable surface 52 is also critical in shearing the bond between the ice and mold cavity 32.

After one-half rotation of auger 14, flights 50 and ramps 58, 60 have lifted the ice approximately 0.1 inch from its original position and the ice loses contact with rotatable surface 52. As auger 14 continues to rotate, flights 50 push the ice cube further upward along shaft 42.

Since there are five flights 50 per vertical inch on shaft 42, it follows that five full rotations of auger 14 will raise the ice by approximately one inch such that the bottom of the ice cube is approximately at the same vertical level as the top edges 36, 38 and 40 of walls 20, 22 and 26, respectively. At this vertical level, or at any other level at which the bottom of the ice cube is above filling level 34, cavity 32 is again filled with water to the level of 34.

As the newly inserted water in cavity 32 begins the freezing process, the ice cube 81 disposed immediately above on shaft 42 begins to freeze more completely. Stress cracks which may have formed in the ice cube due to the forces of auguring are again filled with water seeping in from the middle of the cube. After the water in cavity 32 has partially frozen, the auguring process is recommenced to thereby push the newly formed second cube 83 upward along shaft 42. As the second cube 83 makes contact with the first cube 81, the first cube 81 is pushed further up and off of a top 79 of auger shaft 42. As the first cube 81 comes off of shaft 42, the inner radial walls 85 defining the center through hole 87 in the cube lose the support of shaft 42. Since the first cube may still not be completely frozen at this point, the water inside the cube may expand and rupture the inner radial walls 85, thereby at least partially filling in the center through hole 87. After the first cube has completely slid off of auger 14, it can then drop into a dispenser tray (not shown) below apparatus 10.

In other embodiments, an extension wall 80, a deflector 82, a cube guide wire 84, a cooling device 86 and/or a fin 88 may be included in the ice making apparatus. Extension wall 80 is attached to top edge 40 of back wall 22. Extension wall 80 serves to prevent the ice cubes from rotating along with auger 14 as the cubes progress along the upper portion of shaft 42. Thus, an ice cube can be released off of top 79 of shaft 42, even without the benefit of a second cube below it to provide an upward pushing force.

Deflector 82 is attached to a top edge 90 of extension wall 80. Deflector 82 serves to direct the ice cubes in a predetermined direction, i.e., over front wall 20, as the cubes come off of shaft 42. Thus, the ice cubes may be directed into a dispenser tray, for example, that is positioned below front wall 20.

Cube guide wire 84 is an elongate guiding element attached to top 79 of auger shaft 42. Cube guide wire 84 is received in the center through hole in the ice cube as the cube comes off of shaft 42. Cube guide wire 84 slidingly guides the ice cube in a predetermined direction, indicated by arrow 92, possibly towards a dispenser tray.

Cooling device 86 is in the form of a refrigeration coil 94 and a tube 96 extending through back wall 22 and extension wall 80 of mold 12. Thus, cooling device 86 directly contacts and directly cools mold 12, rather than indirectly cooling mold 12 by cooling the air surrounding mold 12. The direct cooling of mold 12 ensures that the water adjacent to mold 12 in cavity 32 freezes first, thereby forming an outer shell of ice surrounding an inner core of water.

Fin 88 extends vertically along inner surface 28 of back wall 22. Fin 88 functions to increase the surface area of inner surface 28 that is in contact with the water in cavity 32. The increased surface area provides improved heat transfer between mold 12 and the water, and results in quicker freezing of the water. If the mold cavity is substantially circular, fin 88 has the additional advantage of preventing rotation of the ice as auger 14 rotates.

In one embodiment, each of perimeter walls 20, 22, 26 and 27 extends vertically approximately to the vertical level of top 79 of auger shaft 42, as indicated at 98. As is evident in FIG. 3, an inner surfaces 100 of the extended portions of perimeter walls 20, 22, 26 and 27 do not continue the outward flare of inner surfaces 28. Rather, inner surfaces 100 are oriented substantially vertically, i.e., parallel to shaft 42.

In operation, if cavity 32 is filled with water substantially to the level of top edges 36, 38 and 40, and a top of a first cube 81 is substantially adjacent to level 98 when a second cube 83 is being formed in cavity 32, the first cube 81 can substantially seal off cavity 32 from the ambient air outside of mold 12. Thus, the water in cavity 32 can be prevented from vaporizing and thereby forming frost on the walls (not shown) of the freezer in which mold 12 is located. That is, the extension of perimeter walls 20, 22, 26 and 27 to the level of 98 allows the first ice cube 81 to seal cavity 32 from the ambient air after cavity 32 has been refilled with water, thereby substantially inhibiting the formation of frost within the surrounding freezer.

In yet another embodiment, ramps 53 and 60 are replaced with another ice lifting device in the form of actuators 102. Actuators 102 push up on the bottom of the ice cube in order to break the bond between the ice and rotatable surface 52 of auger 14. Actuators 102 may be powered pneumatically, hydraulically or electrically, such as by drive mechanism 18, for example. The vertical rise of the ice-interfacing, top surface 104 of actuators 102 can be synchronized with the rotation of auger 14 in order to match the vertical rise of the ice as provided by flights 50.

In the embodiments shown, perimeter walls 20, 22 and 26 of mold cavity 32 are arranged in a non-circular shape. However, it is to be understood that it is also possible, in an alternative embodiment, for perimeter walls 20, 22, 26 and 27 to form a circular shape. In this alternative embodiment, auger 14 is eccentrically disposed, i.e., horizontally displaced from a the center of mold cavity 32, in order to prevent the ice from rotating in mold cavity 32 along with auger 14.

Figure 4:
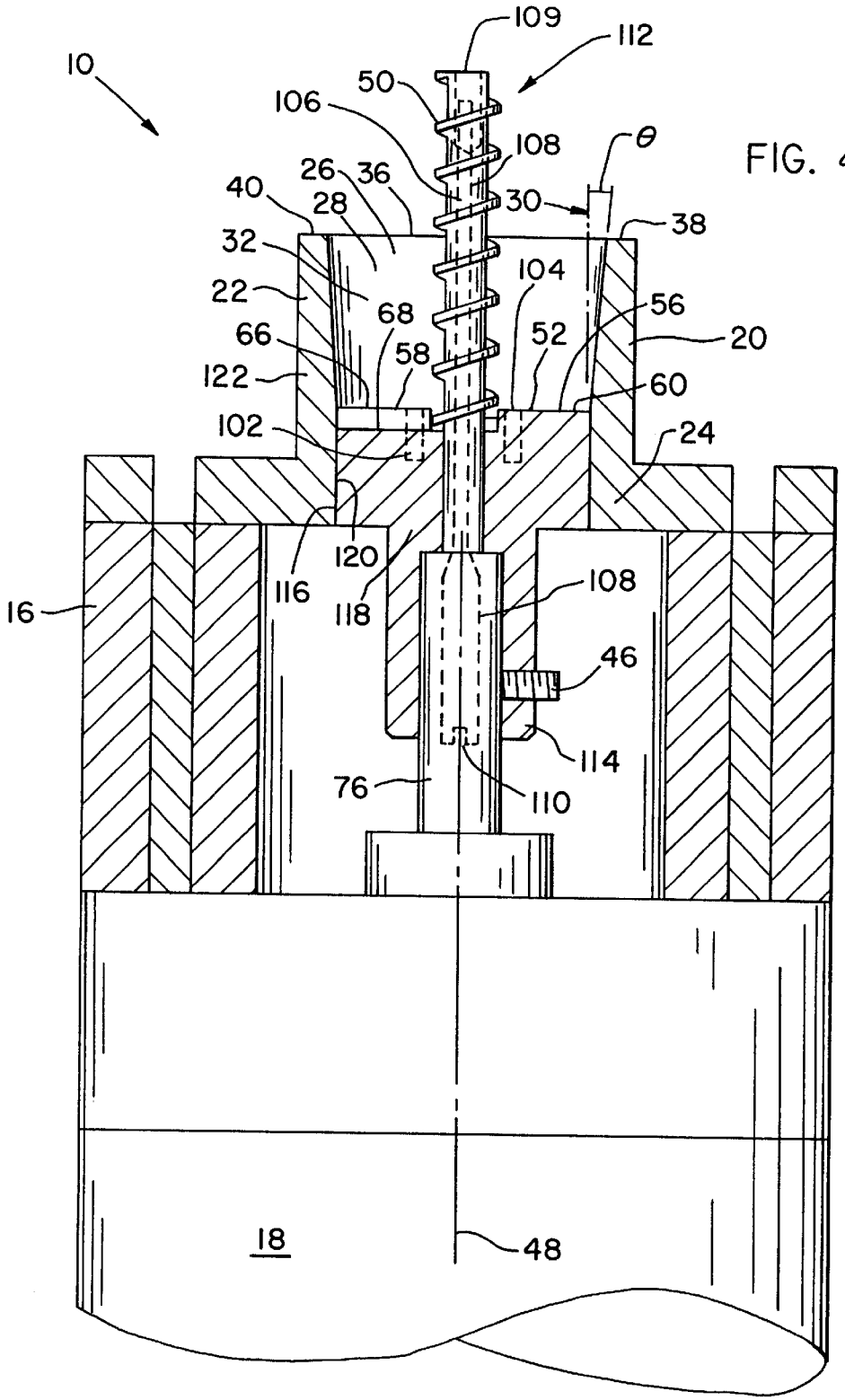
FIG. 4 is a front, partially sectional view of yet another embodiment of an ice making apparatus of the present invention.

In another embodiment (FIG. 4), a shaft 106 includes an internal heat pipe 108 with a valve fill hole 110. A fluid within heat pipe 108 absorbs heat in cavity 32 and vaporizes. The vapor rises in heat pipe 108, releases the heat near top 109 of shaft 106, condensates, and falls back into cavity 32 where the cycle repeats. Thus, the absorption of heat from cavity 32 by heat pipe 108 promotes the radially inward freezing of ice cube 81. As such, heat pipe 108 is an active means of transferring thermal energy from cavity 32. However, heat pipe 108 could be replaced with an auger 14 made of a material with a substantial heat transfer coefficient, thereby relying on the conductance of heat away from cavity 32 through auger 14 to chilled mold 12 to freeze ice cube 81 radially inwardly.

Drive mechanism 18 functions to rotate auger 112 through output shaft 76 which is coupled with shank 114 via a set screw 46. An outer perimeter 116 of a lifter 118 has a clearance of approximately 0.005 inch from an inside surface 120 of a mold 122. At a temperature of, for example, 25° F., any water which seeps in between perimeter 116 of lifter 118 and inside surface 120 of mold 122 freezes and thereby seals the gap.

Figure 5:
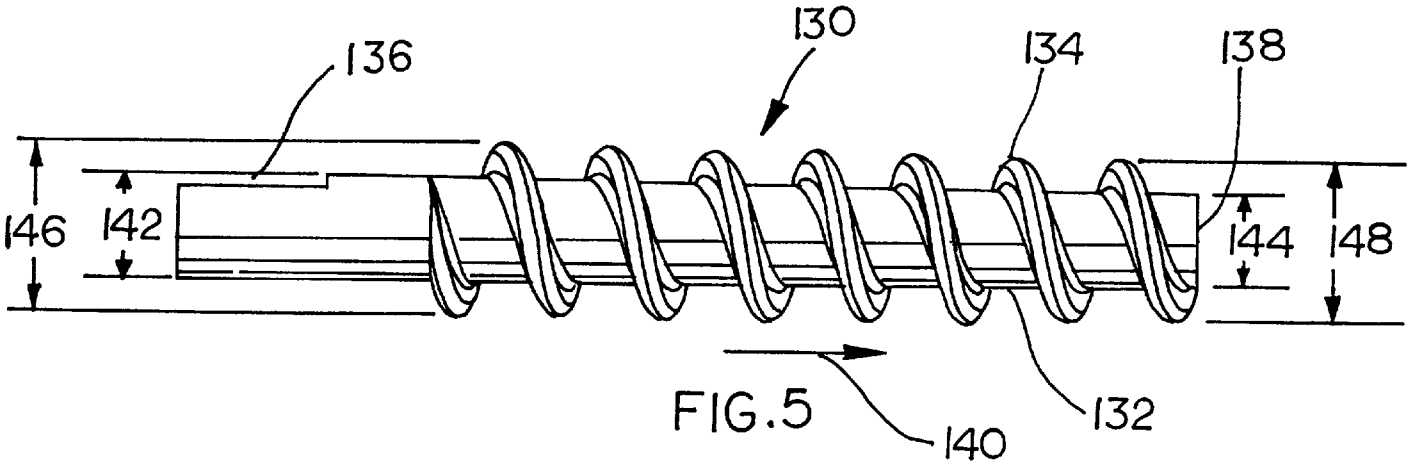
FIG. 5 is a side view of another embodiment of an auger for the ice making apparatus of the present invention.
Figure 7:
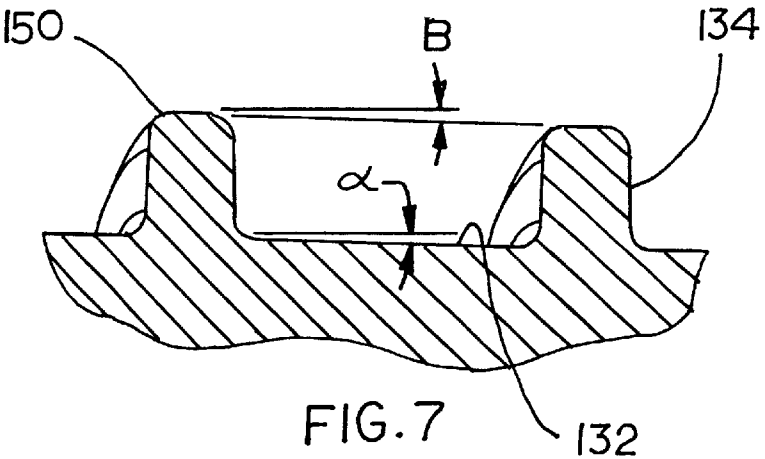
FIG. 7 is an exaggerated, fragmentary, sectional view of the auger shown in FIGS. 5 and 6 as viewed alone line 7–7 of FIG. 6.
Figure 6:
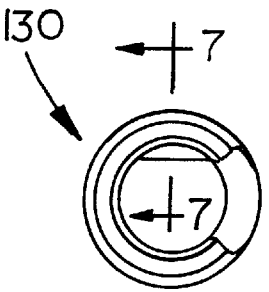
FIG. 6 is an end view of the auger shown in FIG. 5.

A further embodiment of an auger 130 is shown in FIGS. 5–7. Shaft 132 of auger 130 has a single continuous flight 134 mounted thereon, for purposes of illustration. Of course, multiple flights, continuous or spaced, may instead be employed. Shaft 132 has a top end 138 and a base end 136 configured for coupling with drive mechanism 18 to rotate auger 130. The direction from base end 136 to top end 138 constitutes an output direction 140, the direction in which ice cube 81 is to be pushed out of mold 12. In this embodiment, shaft 132 and/or flight 134 has an inward taper, thus becoming increasingly more narrow, in output direction 140. The provision of at least one such inward taper allows ice cube 81 (FIG. 3) to automatically become separated from at least a portion of auger 130 upon movement of ice cube 81 in output direction 140.

Both shaft 132 and flight 134 are shown to be tapered, as best shown in FIG. 7, the inward taper of shaft 132 being shown as angle $\alpha$, and the inward taper of flight 134 being shown as angle $\beta$. Each of taper angle $\alpha$ and taper angle $\beta$ may be between approximately 0.1° and 5°, preferably between about 0.2° and 0.8°, and more preferably about 0.5°. In achieving an inward taper of shaft 132, maximum diameter 142 near base end 136 is greater than the minimum diameter 144 at top end 138. Similarly, in achieving an inward taper of flight 134, maximum outer diameter 146 near base end 136 is greater than the minimum outer diameter 148 at top end 138. The maximum diameter in each instance should exceed the corresponding minimum diameter by between about 0.005 and 0.1 inch and preferably by between about 0.007 and 0.04 inch. For example, maximum outer diameter 146 of flight 134 near base end 136 may be about 0.33 inch and minimum outer diameter 148 thereof at top end 138 may be about 0.31 inch.

As best seen in the break-away longitudinal cross section of auger 130 (FIG. 7), flight 134 has a radial periphery a partially rounded portion 150. Rounded portion 150 provides less surface area for ice cube 81 to contact upon movement thereof out of mold 12, easing separation thereof from auger 130. Additionally, the rounding eliminates potentially sharp surfaces upon which ice cube 81 could be damaged.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ice making apparatus, comprising:

a mold including at least one cavity having a bottom surface, said at least one mold cavity being configured for containing water therein for freezing into ice; and an auger comprising a shaft having a longitudinal axis and having at least one flight attached thereto, said shaft including a top end and a base end, said base end rotatably mounted in said bottom surface of said at least one mold cavity, said shaft extending substantially vertically through said at least one mold cavity and being configured to rotate and thereby push the ice out of said at least one mold cavity, at least one of said shaft and said at least one flight having a radius relative to said axis which decreases in a direction heading from said base end to said top end of said shaft to define a radially inward taper.

2. The ice making apparatus of claim 1, wherein said at least one flight includes a single substantially continuous flight extending from near said base end to said top end of said shaft.

3. The ice making apparatus of claim 1, wherein said taper has an associated taper angle of approximately 0.1° to approximately 5°.

4. The ice making apparatus of claim 3, wherein said taper angle is approximately 0.5°.

5. The ice making apparatus of claim 1, wherein said shaft has a minimum diameter at said top end and a maximum diameter near said base end.

6. The ice making apparatus of claim 5, wherein said maximum diameter of said shaft exceeds said minimum diameter of said shaft by between about 0.005 in and about 0.100 in.

7. The ice making apparatus of claim 6, wherein said maximum diameter of said shaft exceeds said minimum diameter of said shaft by between about 0.007 in and about 0.04 in.

8. The ice making apparatus of claim 1, wherein said at least one flight has a minimum outer diameter at said top end of said shaft and has a maximum outer diameter near said base end of said shaft.

9. The ice making apparatus of claim 8, wherein said maximum outer diameter of said at least one flight exceeds said minimum diameter of said at least one flight by between about 0.005 in and about 0.100 in.

10. The ice making apparatus of claim 9, wherein said maximum outer diameter of said at least one flight exceeds said minimum diameter of said at least one flight by between about 0.007 in and about 0.04 in.

11. The ice making apparatus of claim 8, wherein said minimum outer diameter of said at least one flight at said top end is about 0.31 in and said maximum outer diameter of said at least one flight near said base end is about 0.33 in.

12. The ice making apparatus of claim 1, wherein said shaft and said at least one flight each have a radius which decreases in a direction heading from said base end to said top end of said shaft.

13. The ice making apparatus of claim 1, wherein said at least one flight has a radial periphery with at least a partially rounded contour.

14. An ice making apparatus, comprising:

a mold including a cavity and being configured for containing water therein for freezing into ice; and an auger extending substantially vertically through said mold cavity, said auger comprising a shaft having at least one flight attached thereto, said auger being configured for rotating to thereby push the ice out of said mold cavity and at least one of said shaft and at least one flight having a taper configured to progressively separate the ice from said at least one of said shaft and said at least one flight as the ice is pushed out of said mold cavity.

15. A method of making ice, comprising the steps of:

providing a mold with a cavity;

filling said mold cavity to a predetermined level with water;

freezing the water at least partially to form an at least partially frozen piece of ice;

pushing the at least partially frozen piece of ice through said mold cavity in an outlet direction toward an outlet end of said mold cavity by rotating an auger rotatably mounted within said mold, said auger comprising a shaft having a longitudinal axis and having at least one flight attached thereto, at least one of said shaft and said at least one flight having a radius relative to said axis which decreases in said outlet direction to define a radially inward taper in said outlet direction; and creating separation between the at least partially frozen piece of ice and at least one of said shaft and said at least one flight as the at least partially frozen piece of ice is being pushed through said mold cavity due to the presence of said taper.

16. The ice making method of claim 15, wherein said inward taper has an associated taper angle of approximately 0.1° to approximately 5°.

17. The ice making method of claim 15, wherein said shaft includes a top end and a base end, said base end rotatably mounted in said bottom surface of said mold cavity.

18. The ice making method of claim 17, wherein said shaft has a minimum diameter at said top end and has a maximum diameter near said base end.

19. The ice making method of claim 17, wherein said at least one flight has a minimum outer diameter at said top end of said shaft and has a maximum outer diameter near said base end of said shaft.

20. The ice making method of claim 15, wherein said at least one flight has a radial periphery with at least a partially rounded contour.

21. An ice making apparatus, comprising:

a mold including a cavity and being configured for containing water therein for freezing into ice; and an auger extending substantially vertically through said mold cavity, said auger comprising a shaft having at least one flight attached thereto, each of said auger and said mold having an absence of heat applied thereto, said auger being configured for conveying the ice thereon, separating the ice from said mold cavity and pushing the ice out of said mold cavity, said auger being configured for progressively separating at least a portion of itself from the ice during the conveying thereof.

22. An ice making apparatus, comprising:

a mold including a cavity and being configured for containing water therein for freezing into ice; and an auger extending substantially vertically through said mold cavity, said auger comprising a shaft having at least one flight attached thereto, each of said auger and said mold having an absence of heat applied thereto, said auger being configured for separating the ice from said mold cavity and pushing the ice out of said mold cavity, at least one of said shaft and said at least one flight having a taper configured to progressively separate the ice from said at least one of said shaft and said at least one flight as the ice is pushed out of said mold cavity.

* * * * *